US010697045B2

(12) United States Patent
Yang et al.

(10) Patent No.: US 10,697,045 B2
(45) Date of Patent: Jun. 30, 2020

(54) LEAD-FREE EASY-CUTTING HIGH-STRENGTH CORROSION-RESISTANT SILICON-BRASS ALLOY AND THE PREPARATION METHOD AND USE THEREOF

(71) Applicants: South China University of Technology, Guangzhou (CN); Kaiping Freendo Sanitary Ware Co., Ltd., Kaiping (CN)

(72) Inventors: Chao Yang, Guangzhou (CN); Zhi Ding, Guangzhou (CN); Yanfei Ding, Kaiping (CN); Songzhan Feng, Kaiping (CN)

(73) Assignees: South China University of Technology, Guangzhou (CN); Kaiping Freendo Sanitary Ware Co., Ltd., Kaiping (CN)

( * ) Notice: Subject to any disclaimer, the term of this patent is extended or adjusted under 35 U.S.C. 154(b) by 312 days.

(21) Appl. No.: 15/573,774

(22) PCT Filed: Dec. 15, 2016

(86) PCT No.: PCT/CN2016/110021
§ 371 (c)(1),
(2) Date: Nov. 13, 2017

(87) PCT Pub. No.: WO2017/071672
PCT Pub. Date: May 4, 2017

(65) Prior Publication Data

US 2018/0148813 A1 May 31, 2018

(30) Foreign Application Priority Data

Oct. 27, 2015 (CN) ..... 2015 1 0714013

(51) Int. Cl.
*C22C 9/04* (2006.01)
*C22C 1/03* (2006.01)
*C22C 1/02* (2006.01)

(52) U.S. Cl.
CPC ..... *C22C 9/04* (2013.01); *C22C 1/02* (2013.01); *C22C 1/03* (2013.01)

(58) Field of Classification Search
None
See application file for complete search history.

(56) References Cited

U.S. PATENT DOCUMENTS 5,582,281 A * 12/1996 Nakashima ..... B21K 25/00 148/532
2004/0159375 A1 8/2004 Yamagishi
(Continued)

FOREIGN PATENT DOCUMENTS

CN 1521281 A 8/2004
CN 101386931 A 3/2009
(Continued)

OTHER PUBLICATIONS

English Translation of CN 101386931 (originally published Mar. 18, 2009) from Espacenet.*

*Primary Examiner* — George Wyszomierski
(74) *Attorney, Agent, or Firm* — Hoffmann & Baron, LLP

(57) ABSTRACT

The present invention relates to a lead-free easy-cutting high-strength corrosion-resistant silicon-brass alloy and the preparation method and use thereof. The mass percent composition of the alloy is: 56~60% Cu, 38~42% Zn, 0.003~0.01% B, 0.03~0.06% Ti, and 1.0~1.5% Si and 0.5~0.9% Al or 0.5~0.8% Si and 1~1.5% Al, and the zinc equivalent of all components is between 48% and 50%. In the present invention, the phase composition and the distribution state of the alloy can be regulated by controlling the contents of Si and Al elements, as well as by adding a B and
(Continued)

Ti composite grain refiner, in order to obtain a copper alloy with the advantages of excellent comprehensive performance of strength, process ability and dezincification resistance, a high production yield, and low costs, which can replace lead brass and bismuth brass for plumbing, bathroom and a variety of corrosion-resistant parts, and has a bright prospect of popularization and application.

2 Claims, 1 Drawing Sheet

(56) References Cited

U.S. PATENT DOCUMENTS

| | | | | |
|---|---|---|---|---|
| 2010/0098579 | A1* | 4/2010 | Xu | C22C 9/04 420/471 |
| 2011/0104000 | A1* | 5/2011 | Xu | C22C 9/04 420/471 |
| 2012/0251382 | A1 | 10/2012 | Peng et al. | |
| 2015/0071813 | A1* | 3/2015 | Yamada | C22C 9/04 420/471 |

FOREIGN PATENT DOCUMENTS

| | | | |
|---|---|---|---|
| CN | 102071336 | A | 5/2011 |
| CN | 104372199 | A | 2/2015 |
| CN | 105274387 | A | 1/2016 |
| JP | H03170646 | A | 7/1991 |
| JP | H06184676 | A | 7/1994 |

* cited by examiner

LEAD-FREE EASY-CUTTING HIGH-STRENGTH CORROSION-RESISTANT SILICON-BRASS ALLOY AND THE PREPARATION METHOD AND USE THEREOF

CROSS-REFERENCE TO RELATED APPLICATIONS

This application is the U.S. National Phase of International Patent Application No. PCT/CN2016/110021, filed on 15 Dec. 2016, which claims benefit of Chinese Patent Application No. 201510714013.X, filed on 27 Oct. 2015, the contents of which are incorporated herein by reference in their entirety.

FIELD OF THE INVENTION

The present invention relates to the technical field of the alloy materials, and in particular to a lead-free easy-cutting high-strength corrosion-resistant silicon-brass alloy and the preparation method and use thereof.

BACKGROUND OF THE INVENTION

In order to reduce the harmful effects of lead in lead brass faucets, relevant researchers from both China and overseas have studied the corrosion mechanism of brass caused by drinking water and the effect on the corrosion resistance by adding alloying elements to brass. Various measures have been taken to improve the corrosion resistance of brass, such as adding tin, nickel or other alloying elements, removing the soluble lead, or inhibiting the leaching of lead and so on. However, since lead is an alloy element of such brass and always exists in brass, the above methods can only reduce the side effects of lead to a certain extent and cannot fundamentally eliminate the harm of lead. In view of this, there is an important issue to be solved in the industry in finding a new alternative material for a copper alloy faucet.

In recent years, a lot of research on lead-free easy cutting brass has been conducted both in China and overseas, and some achievements have already been achieved, mainly utilizing silicon, bismuth, magnesium, antimony and graphite instead of lead. In particular, silicon brass has excellent performance of casting, thermal processing, welding, resistance to dezincification, and stress corrosion, coupled with the low-cost advantage of silicon, so the position of brass material in the green and environmentally friendly lead-free easy cutting industry is particularly prominent. Among them, the patent reference "Easily processed silicon brass alloy and preparation method thereof" filed by the Jomoo Kitchen & Bathroom Appliances Co., Ltd. (publication No. CN 104651660 A, Reference Document 1) discloses that the composition of the alloy includes: 60-63 wt % Cu, 0.50-0.90 wt % Si, 0.50-0.80 wt % Al, 0.10-0.20 wt % Pb, less than 0.3 wt % other additional trace elements, with the balance being Zn and unavoidable impurities. However, the silicon brass alloy still contains the constituent of Pb. By calculating the zinc equivalent of the example in this patent reference, the structure of such alloys should consist of two phases of α and β.

The patent reference "Lead-free silicon brass alloy and preparation method" filed by the Jiuxing Holding Group (publication No. CN 103725922 A, Reference Document 2) discloses the composition of the alloy includes: 59-63 wt % Cu, 1-1.5 wt % Si, 0.001-0.05 wt % Al, 0.001-0.01 wt % B, 0.1-0.5 wt % Fe, 0.1-0.2 wt % Mn, 0.1-0.15 wt % Sn, 0.05-0.5 wt % P, 0.01-0.07 wt % rare earth element RE, with the balance being zinc and unavoidable impurities. By calculating the zinc equivalent of the example in this patent reference, the structure of such alloys should consist of two phases of α and β. However, the tensile strength of 430 MPa-460 MPa can be further increased to some extent, and the dezincification layer thickness of 210 μm can also be further reduced to some extent, so as to obtain more excellent comprehensive performance.

In addition, although the above patent references disclose the specific composition range of the alloy, the design principles and phase composition are not specified. In fact, the design principles and the phase compositions of the alloy greatly affect the tensile strength, the corrosion resistance, the cutting performance, and other comprehensive performance of the copper alloy.

The study on α and β biphasic brass, such as HPb59-1 lead brass, shows that the strength and hardness of β phase (CuZn-based solid solution) are higher than those of a phase (solid solution of Zn dissolved in Cu), but the β phase can be processed in hot and cold pressure and has better plasticity especially under hot processing conditions. However the γ phase (the solid solution based on an electronic compound $Cu_5Zn_8$) is different in that it is a hard brittle phase and is distributed like stars in the matrix in a casting state, which brings negative effects on the mechanical processing performance and service performance. Therefore, if a brass alloy had a β phase matrix where tiny dot-like γ phase was uniformly distributed, which played the role of breaking the chip in the cutting, the brass alloy would have similar cutting performance to lead brass. The key to realizing the idea is to design an appropriate zinc equivalent, so that the alloy consists of two phases, β and γ, and the γ phase is distributed, in a tiny dot-like and uniform dispersion manner, in the β phase matrix after a modification treatment.

According to the studies on brass, zinc equivalent should be at least 48 wt % or more if there is a γ phase generated in the alloy. Correspondingly, for a multi-component copper alloy, the necessary condition for the formation of γ phase is that the zinc equivalent of the alloy must be greater than 48 wt %. However, a zinc equivalent that is too high will result in the decrease of the plasticity of the alloy and seriously affect the cutting performance.

The formula for calculating the zinc equivalent is:

$$X\ (\%) = \frac{C_{Zn} + \sum C_i K_i}{C_{Zn} + C_{Cu} + \sum C_i K_i} \times 100\%,$$

wherein X is the zinc equivalent of complex brass after adding the alloying elements; $C_{Zn}$ is the actual zinc content added to the alloy; $C_{Cu}$ is the pure copper content actually added to the alloy; $\Sigma C_i K_i$ is the product sum of all alloying elements contents $C_i$ added to the alloy and the respective zinc equivalent values (zinc equivalents) $K_i$ of the added alloying elements. Among them, the main regulating elements of the zinc equivalent of the brass alloy are silicon and aluminum, and their zinc equivalents are 10 and 6, respectively. Therefore, the zinc equivalent of the alloy can be regulated by the reasonable regulation of the contents of silicon and aluminum, and then the phase composition and the comprehensive performance of the alloy can be controlled.

In view of this, if a copper alloy composed of two phases, β and γ, were obtained by reasonable regulation of zinc equivalent and the γ phase was distributed in a tiny dot-like and uniform dispersion manner in the β phase matrix after a modification treatment, the lead-free copper alloy with excellent comprehensive performance of tensile strength, corrosion resistance, cutting, and the like would be produced to replace the lead brass material commonly used in the industry, which has an important theoretical and engineering significance.

SUMMARY OF THE INVENTION

In order to solve the above-mentioned problems in the prior art, a first object of the present invention is to provide a lead-free easy-cutting high-strength corrosion-resistant silicon-brass alloy.

Another object of the present invention is to provide a preparation method of the above-mentioned lead-free easy-cutting high-strength corrosion-resistant silicon-brass alloy.

The object of the present invention is achieved by the following technical solutions:

A lead-free easy-cutting high-strength corrosion-resistant silicon-brass alloy consists of the components of the following percentages listed in (1) or (2):

(1) 56~60 wt % Cu, 1.0~1.5% wt % Si, 0.5~0.9% wt % Al, 38%~42% wt % Zn, 0.003~0.01% wt % B, 0.03~0.06% wt % Ti, and unavoidable trace impurities; or (2) 56~60 wt % Cu, 0.5~0.8% wt % Si, 1~1.5%% wt % Al, 38%~42% wt % Zn, 0.003~0.01% wt % B, 0.03~0.06% wt % Ti, and unavoidable trace impurities; and the zinc equivalent of all components is between 48% and 50%.

The structure of the lead-free easy-cutting high-strength corrosion-resistant silicon-brass alloy includes two component phases of β and γ, wherein the β phase with a grain size of 200-400 μm is as the matrix and the fine spherical γ phase uniformly and dispersedly distributed in the grains of β phase is as the strengthening phase.

The preparation method of the above-mentioned lead-free easy-cutting high-strength corrosion-resistant silicon-brass alloy includes the following preparation steps:

(1) designing the contents of Cu, Zn, Si and Al alloying elements so that the calculated zinc equivalent is between 48%~50%;

(2) preheating a crucible to 400~500° C., and then placing the red copper and copper-silicon intermediate alloy materials in the bottom of the crucible, increasing the temperature to 1050~1100° C. until all the red copper and copper-silicon intermediate alloys are melted and the composition is homogenized, then adding borax on the molten liquid surface as a cover flux;

(3) reducing the temperature to 400~700° C., and adding aluminum ingots and zinc ingots sequentially;

(4) after all the aluminum ingots and the zinc ingots have been melted, increasing the temperature to 1050~1100° C., and stirring to homogenize the alloy melt composition;

(5) coating the intermediate alloy blocks such as copper boron blocks or copper titanium blocks with an aluminum foil, and then pressing the intermediate alloy blocks into the alloy melt utilizing a bell-jar process for a modification treatment, stirring the alloy melt again to homogenize the alloy melt composition;

(6) leaving the alloy melt to stand at 1050~1100° C. for 10~30 minutes to homogenize the alloy melt composition; and (7) filtering out the scum and impurities, casting the alloy melt at 950~1050° C., then cooling it to room temperature, to obtain the lead-free easy-cutting high-strength corrosion-resistant silicon-brass alloy.

The present invention also provides the use of the above-mentioned lead-free easy-cutting high-strength corrosion-resistant silicon-brass alloy in plumbing and bathroom industry.

The preparation method and the product produced have the following effects and advantages:

(1) In the present invention, the zinc equivalent is regulated by the regulation of the contents of Cu, Zn, Si, Al alloying elements, and then the lead-free copper alloy with controllable phase composition and distribution state is obtained. The design principle of the alloy is reasonable, simple and easy.

(2) The brass alloys in the present invention have Si, Al elements instead of Pb element, which lowers the costs, and at the same time realizes the lead-free cutting brass, and also are beneficial to being environmentally friendly and to health.

(3) The brass alloy produced in present invention has good casting performance without defects such as hot cracking, pores, etc., in the casting process and a high product rate, so that it can be produced in large scale by the process of gravity casting and low pressure casting.

(4) The lead-free easy-cutting high-strength corrosion-resistant silicon-brass alloy produced in present invention has excellent comprehensive performances, such as high tensile strength, good dezincification, etc., and has a bright application prospect in the plumbing and bathroom industry.

DETAILED DESCRIPTION OF THE INVENTION

The present invention will be further described in detail below with reference to examples and figures; however, the embodiments of the present invention are not limited thereto.

Example 1

(1) designing the contents of Cu, Zn, Si and Al alloying elements of 58 wt %, 40.2 wt %, 1.0% wt % and 0.8% wt %, respectively, with the calculated zinc equivalent being 48.7%; additionally, designing the contents of the B and Ti grain refiners in the alloy to be 0.005% wt % and 0.03% wt %, respectively;

(2) firstly preheating a crucible to 400~500° C., and then placing red copper and copper-silicon intermediate alloy materials in the bottom of the crucible; increasing the temperature to 1050~1100° C. until all the red copper and copper-silicon intermediate alloys are melted and the composition are homogenized, and then adding a small amount of borax to the molten liquid surface as a cover flux;

(3) reducing the temperature to 400~700° C., and adding aluminum ingots and zinc ingots sequentially;

(4) after all the aluminum ingots and the zinc ingots have been melted, increasing the temperature to 1050~1100, and stirring with a graphite rod to homogenize the alloy melt composition as much as possible;

(5) coating the intermediate alloy blocks such as copper boron blocks or copper titanium blocks with an aluminum foil, and pressing the intermediate alloy blocks into the alloy melt utilizing a bell-jar process for a modification treatment; stirring the alloy melt with a graphite rod again to homogenize the alloy melt composition as much as possible;

(6) leaving the alloy melt to stand at 1050~1100° C. for 10~30 minutes to homogenize the alloy melt composition; and (7) filtering out the scum and impurities; casting the alloy melt at 950~1050° C., then cooling it to room temperature, to obtain the lead-free easy-cutting high-strength corrosion-resistant silicon-brass alloy.

Figure 1:
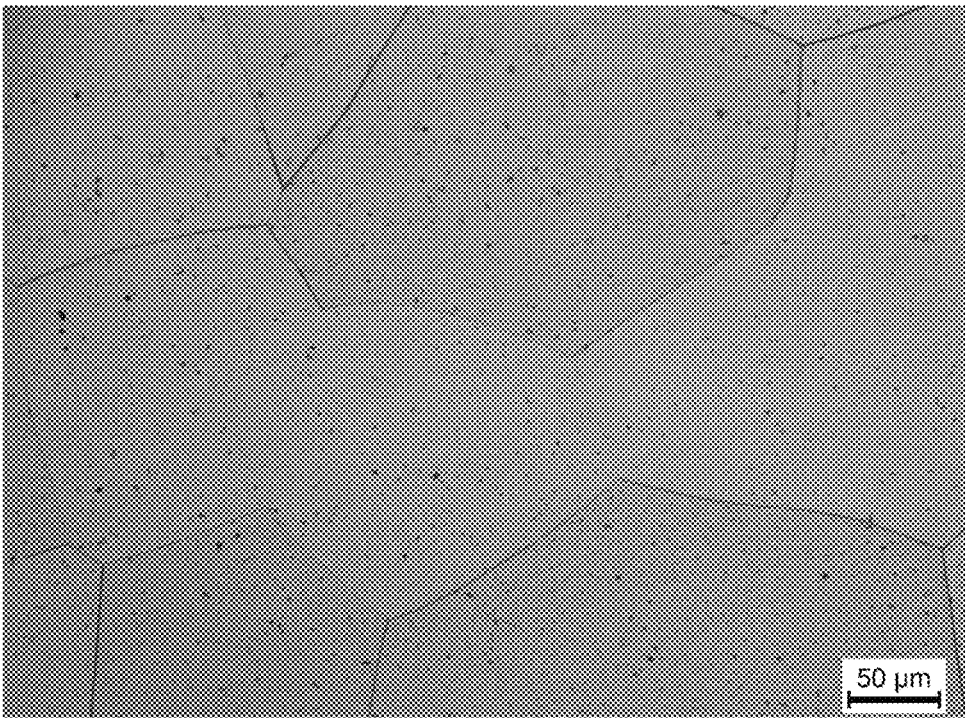
FIG. 1 shows an optical morphology picture of the lead-free easy-cutting high-strength corrosion-resistant silicon-brass alloy produced in Example 1.
Figure 2:
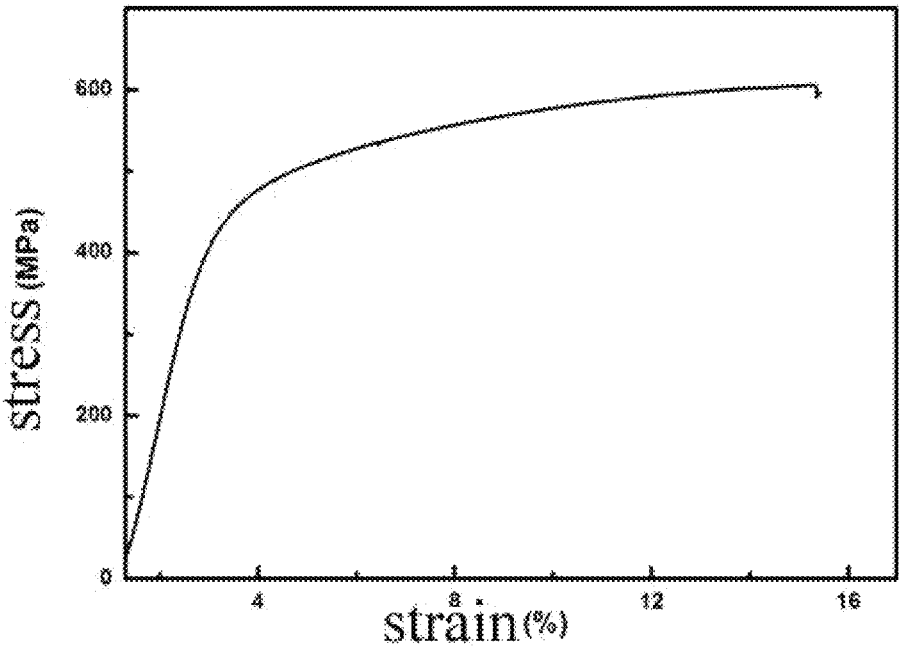
FIG. 2 shows the tensile stress-strain curve of the lead-free easy-cutting high-strength corrosion-resistant silicon-brass alloy produced in Example 1.

The X-ray diffraction analysis of the lead-free easy-cutting high-strength corrosion-resistant silicon-brass alloy produced in this example shows that the silicon-brass alloy includes two component phases of β and γ (the zinc equivalent of the copper alloy composition in the example disclosed in Reference Document 2 is 42.3%-43.9%, and it is speculated that it includes two component phases of β and γ). The optical morphology picture is shown in FIG. 1, which shows that the grain size of the β-phase matrix in the silicon brass alloy is 250~350 μm and fine spherical grains of the γ phase are uniformly and dispersedly distributed in the grains of the β phase. The tensile stress-strain curve is shown in FIG. 2, which shows that the tensile strength of the silicon-brass alloy is 605 MPa (the maximum tensile strength of the copper alloy composition of the embodiment disclosed in Reference Document 1 is 520.3 MPa), and the elongation is 15.3%, which is better than the tensile strength of 503.1 MPa of the copper alloy disclosed in Reference Document 1. The corrosion test of the silicon brass alloy in this example shows that the depth of the dezincification layer is 111.3 m, which is better than the dezincification layer thickness of 152.86 μm in the copper alloy disclosed in Reference Document 1.

Example 2

(1) designing the contents of Cu, Zn, Si and Al alloying elements of 58 wt %, 40.1 wt %, 0.6% wt % and 1.3% wt %, respectively, with the calculated zinc equivalent being 48.7%; additionally designing the contents of the B and Ti grain refiners in the alloy to be 0.008% wt % and 0.05% wt %, respectively;

(2) firstly preheating a crucible to 400~500° C., and then placing red copper and copper-silicon intermediate alloy materials in the bottom of the crucible; increasing the temperature to 1050~1100° C. until all the red copper and copper-silicon intermediate alloys are melted and the composition is homogenized, and then adding a small amount of borax to the molten liquid surface as a cover flux;

(3) reducing the temperature to 400~700° C., and adding aluminum ingots and zinc ingots sequentially;

(4) after all the aluminum ingots and the zinc ingots have been melted, increasing the temperature to 1050~1100, and stirring with a graphite rod to homogenize the alloy melt composition as much as possible;

(5) coating the intermediate alloy blocks such as copper boron blocks or copper titanium blocks with an aluminum foil, and pressing the intermediate alloy blocks into the alloy melt utilizing a bell-jar process for a modification treatment; stirring the alloy melt with a graphite rod again to homogenize the alloy melt composition as much as possible;

(6) leaving the alloy melt to stand at 1050~1100° C. for 10~30 minutes to homogenize the alloy melt composition; and (7) filtering out the scum and impurities; casting the alloy melt at 950~1050° C., and cooling it to room temperature, to obtain the lead-free easy-cutting high-strength corrosion-resistant silicon-brass alloy.

The X-ray diffraction analysis of the lead-free easy-cutting high-strength corrosion-resistant silicon-brass alloy produced in this example shows that the silicon-brass alloy includes two component phases of β and γ (the zinc equivalent of the copper alloy composition in the embodiment disclosed in Reference Document 2 is 44.22%-45.8%, and it is speculated that it includes two component phases of α and β). The optical morphology picture shows that the grain size of the β-phase matrix in the silicon brass alloy is 250-350 μm and the fine spherical grains of the γ phase are uniformly and dispersedly distributed in the grains of the β phase. The tensile stress-strain curve shows that the tensile strength of the silicon-brass alloy is 638.2 MPa (the maximum tensile strength of the copper alloy composition of the embodiment disclosed in Reference Document 2 is 452.3 MPa), and the elongation is 14.1%, which is better than the tensile strength of 452.3 MPa of the copper alloy disclosed in Reference Document 2. The corrosion test shows that the depth of the dezincification layer in the silicon brass alloy is 130.0 μm, which is better than the dezincification layer thickness of 205.5 μm in the copper alloy disclosed in Reference Document 2.

Example 3

(1) designing the contents of Cu, Zn, Si and Al alloying elements of 60 wt %, 38 wt %, 1.5% wt % and 0.5% wt %, respectively, with the calculated zinc equivalent being 49.6%; additionally, designing the contents of the B and Ti grain refiners in the alloy to be 0.008% wt % and 0.05% wt % respectively;

(2) firstly preheating a crucible to 400~500° C., and then placing red copper and copper-silicon intermediate alloy materials in the bottom of the crucible; increasing the temperature to 1050~1100° C. until all the red copper and copper-silicon intermediate alloys are melted and the composition is homogenized, and then adding a small amount of borax to the molten liquid surface as a cover flux;

(3) reducing the temperature to 400~700° C., and adding aluminum ingots and zinc ingots sequentially;

(4) after all the aluminum ingots and the zinc ingots have been melted, increasing the temperature to 1050~1100, and stirring with a graphite rod to homogenize the alloy melt composition as much as possible;

(5) coating the intermediate alloy blocks such as copper boron blocks or copper titanium blocks with an aluminum foil, and pressing the intermediate alloy blocks into the alloy melt utilizing a bell-jar process for a modification treatment; stirring the alloy melt with a graphite rod again to homogenize the alloy melt composition as much as possible;

(6) leaving the alloy melt to stand at 1050~1100° C. for 10~30 minutes to homogenize the alloy melt composition; and (7) filtering out the scum and impurities; casting the alloy melt at 950~1050° C., and cooling it to room temperature, to obtain the lead-free easy-cutting high-strength corrosion-resistant silicon-brass alloy.

The X-ray diffraction analysis of the lead-free easy-cutting high-strength corrosion-resistant silicon-brass alloy produced in this example shows that the silicon-brass alloy includes two component phases of β and γ. The optical morphology picture shows that the grain size of the β-phase matrix in the silicon brass alloy is 300-350 μm and the fine spherical grains of the γ phase are uniformly and dispersedly distributed in the grains of the β phase. The tensile stress-strain curve shows that the tensile strength of the silicon-brass alloy is 610.5 MPa and the elongation is 15.2%, which is better than the tensile strength of 452.3 MPa of the copper alloy disclosed in Reference Document 2. The corrosion test shows that the depth of the dezincification layer in the silicon brass alloy is 135.0 μm, which is better than the thickness of 205.5 μm of dezincification layer in the copper alloy disclosed in Reference Document 2.

Example 4

(1) designing the contents of Cu, Zn, Si and Al alloying elements of 56 wt %, 42 wt %, 0.5% wt % and 1.5% wt %, respectively, with the calculated zinc equivalent being 50%; additionally, designing the contents of the B and Ti grain refiners in the alloy to be 0.008% wt % and 0.05% wt %, respectively;

(2) firstly preheating a crucible to 400~500° C., and then placing red copper and copper-silicon intermediate alloy materials in the bottom of the crucible; increasing the temperature to 1050~1100° C. until all the red copper and copper-silicon intermediate alloys are melted and the composition is homogenized, and then adding a small amount of borax to the molten liquid surface as a cover flux;

(3) reducing the temperature to 400~700° C., and adding aluminum ingots and zinc ingots sequentially;

(4) after all the aluminum ingots and the zinc ingots have been melted, increasing the temperature to 1050~1100, and stirring with a graphite rod to homogenize the alloy melt composition as much as possible;

(5) coating the intermediate alloy blocks such as copper boron blocks or copper titanium blocks with an aluminum foil, and pressing the intermediate alloy blocks into the alloy melt utilizing a bell-jar process for a modification treatment; stirring the alloy melt with a graphite rod again to homogenize the alloy melt composition as much as possible;

(6) leaving the alloy melt to stand at 1050~1100° C. for 10~30 minutes to homogenize the alloy melt composition; and (7) filtering out the scum and impurities; casting the alloy melt at 950~1050° C., and cooling it to room temperature, to obtain the lead-free easy-cutting high-strength corrosion-resistant silicon-brass alloy.

The X-ray diffraction analysis of the lead-free easy-cutting high-strength corrosion-resistant silicon-brass alloy produced in this example shows that the silicon-brass alloy comprises two component phases of β and γ. The optical morphology picture shows that the grain size of the β-phase matrix in the silicon brass alloy is 325-375 μm and the fine spherical grains of the γ phase are uniformly and dispersedly distributed in the grains of the β phase. The tensile stress-strain curve shows that the tensile strength of the silicon-brass alloy is 605 MPa and the elongation is 11.0%, which is better than the tensile strength of 452.3 MPa of the copper alloy disclosed in Reference Document 2. The corrosion test shows that the depth of the dezincification layer in the silicon brass alloy is 125.0 μm, which is better than the thickness of 205.5 μm of dezincification layer in the copper alloy disclosed in Reference Document 2.

The above examples are preferred embodiments of the present invention. However, the embodiments of the present invention are not limited by the above examples, and any other alteration, modification, substitution, combination, and simplification made without departing from the essence and principle of the present invention are equivalent replacements and fall within the scope of protection of the present invention.

What is claimed is:

1. A lead-free easy-cutting high-strength corrosion-resistant silicon-brass alloy, the silicon-brass alloy consisting of components in following percentages:

56~60 wt % Cu, 1.0~1.5% wt % Si, 0.5~0.9% wt % Al, 38%-42% wt % Zn, 0.003~0.01% wt % B, 0.03~0.06% wt % Ti, and unavoidable trace impurities;

wherein a zinc equivalent of the silicon-brass alloy for all the components is between 48% and 50%; and wherein a structure of the silicon-brass alloy comprises component phase β and component phase γ, where the component phase β is a matrix of grains with a grain size of 200 μm-400 μm and the component phase γ phase is fine spherical gains uniformly and dispersedly distributed in the grains of the component phase β.

2. A lead-free easy-cutting high-strength corrosion-resistant silicon-brass alloy, the silicon-brass alloy consisting of components in following percentages:

56~60 wt % Cu, 0.5~0.8% wt % Si, 1~1.5%% wt % Al, 38%-42% wt % Zn, 0.003~0.01% wt % B, 0.03~0.06% wt % Ti, and unavoidable trace impurities;

wherein a zinc equivalent of the silicon-brass alloy for all the components is between 48% and 50%; and wherein a structure of the silicon-brass alloy comprises component phase β and component phase γ, where the component phase β is a matrix of grains with a grain size of 200 μm-400 μm and the component phase γ phase is fine spherical gains uniformly and dispersedly distributed in the grains of the component phase β.

* * * * *